US011274865B2

(12) United States Patent
Han et al.

(10) Patent No.: US 11,274,865 B2
(45) Date of Patent: Mar. 15, 2022

(54) REFRIGERATOR DIAGNOSTIC METHOD AND REFRIGERATOR

(71) Applicant: LG ELECTRONICS INC., Seoul (KR)

(72) Inventors: Jun Soo Han, Seoul (KR); Cho Lok Han, Seoul (KR); Young Hun Yang, Seoul (KR); Jun Seong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 16/719,851

(22) Filed: Dec. 18, 2019

(65) Prior Publication Data

US 2020/0124329 A1 Apr. 23, 2020

(30) Foreign Application Priority Data

Oct. 23, 2019 (KR) ..... 10-2019-0132276

(51) Int. Cl.

| | |
|---|---|
| ***F25B 49/02*** | (2006.01) |
| ***F25B 49/00*** | (2006.01) |
| ***F25B 13/00*** | (2006.01) |
| ***F25D 29/00*** | (2006.01) |

(52) U.S. Cl.

CPC ..... *F25B 49/005* (2013.01); *F25B 13/00* (2013.01); *F25D 29/006* (2013.01); *F25D 29/008* (2013.01); *F25B 2600/11* (2013.01); *F25D 2600/00* (2013.01); *F25D 2600/02* (2013.01)

(58) Field of Classification Search

CPC ..... F25B 49/005; F25B 2700/151; F25B 2700/172; F24F 11/38; F24F 2221/32; F25D 29/00; F25D 29/006; F25D 29/008; F25D 2600/00; F25D 29/02

See application file for complete search history.

(56) References Cited

U.S. PATENT DOCUMENTS

2005/0235660 A1* 10/2005 Pham ..... B23P 15/26 62/126
2006/0086105 A1* 4/2006 Chang ..... F24F 11/30 62/129

(Continued)

FOREIGN PATENT DOCUMENTS

KR 10-2016-0094739 8/2016

*Primary Examiner* — Jonathan Bradford

(74) *Attorney, Agent, or Firm* — Lee, Hong, Degerman, Kang & Waimey PC

(57) ABSTRACT

Disclosed are a refrigerator diagnostic method and a refrigerator using an artificial intelligence algorithm (AI) and/or machine learning algorithm in a 5G environment connected for the Internet of things. The refrigerator diagnostic method may include determining an installation state of a refrigerator based on a power value of a compressor provided in the refrigerator and the number of revolutions of a cooling fan provided in the refrigerator, when an operating time after initial installation of the refrigerator is less than or equal to a particular value, and determining a malfunction and a cleaning state of the refrigerator based on the power value of the compressor and the number of revolutions of the cooling fan, when the operating time after initial installation of the refrigerator exceeds the particular value.

16 Claims, 10 Drawing Sheets

(56) References Cited

U.S. PATENT DOCUMENTS

| | | | | |
|---|---|---|---|---|
| 2008/0209925 | A1* | 9/2008 | Pham | F25B 49/005 62/126 |
| 2019/0232210 | A1* | 8/2019 | Hur | B01D 46/0086 |
| 2019/0298084 | A1* | 10/2019 | Billings | A47F 3/0408 |

* cited by examiner

REFRIGERATOR DIAGNOSTIC METHOD AND REFRIGERATOR

CROSS-REFERENCE TO RELATED APPLICATION(S)

Pursuant to 35 U.S.C. § 119(a), this application claims the benefit of earlier filing date and right of priority to Korean Patent Application No. 10-2019-0132276, filed on Oct. 23, 2019, the contents of which are all hereby incorporated by reference herein in their entirety.

BACKGROUND

1. Technical Field

The present disclosure relates to a refrigerator diagnostic method and a refrigerator. More particularly, the present disclosure relates to a refrigerator diagnostic method and a refrigerator that are capable of diagnosing a malfunction or poor cleaning of the refrigerator.

2. Description of Related Art

The description in this section merely provides background information on embodiments of the present disclosure and does not necessarily constitute the related art.

In view of recent technological developments, there is a need for development of a function that allows a refrigerator itself to determine a malfunction or poor cleaning, in order to provide a user with more convenient functions.

Korean Patent Application Publication No. 10-2016-0094739 discloses a cleaning time alarm apparatus of a refrigerator. In this related art, the cleaning time alarm apparatus includes a sensor configured to measure an amount of dust accumulated in a machine room of a refrigerator, and a controller configured to determine a cleaning time based on the amount of dust inputted from the sensor.

In the case of a refrigerator, when the refrigerator is installed incorrectly, when a malfunction occurs during long-term use of the refrigerator, or when poor cleaning of the refrigerator occurs, if it is possible for the refrigerator itself to diagnose these situations and inform the user of these situations, the user's convenience will be further increased. Thus, there is a need for the development of techniques related to those mentioned above.

SUMMARY OF THE INVENTION

The present disclosure is directed to providing a method that includes determining a cleaning state of a machine room and informing a user of a cleaning time of the machine room, or predicting the cleaning time of the machine room.

The present disclosure is further directed to providing a method that includes identifying operating states of a compressor and a cooling fan, and informing a user of a malfunction of a refrigerator based on the identified operating states.

The present disclosure is further directed to providing a refrigerator diagnostic method that includes measuring the number of revolutions of a cooling fan and power of a compressor, and determining an installation state of a refrigerator based on the measured values.

Aspects of the present disclosure are not limited to those described above, and other aspects not mentioned will be clearly understood by those skilled in the art to which the embodiments of present disclosure pertain from the following description.

A refrigerator diagnostic method according to one embodiment of the present disclosure may include determining an installation state of a refrigerator based on a power value of a compressor provided in the refrigerator and the number of revolutions of a cooling fan provided in the refrigerator, when an operating time after initial installation of the refrigerator is less than or equal to a particular value; and determining a malfunction and a cleaning state of the refrigerator based on the power value of the compressor and the number of revolutions of the cooling fan, when the operating time after initial installation of the refrigerator exceeds the particular value.

The refrigerator may further include a condenser connected to the compressor and configured to be cooled by the cooling fan, and a controller configured to control operations of the compressor, the cooling fan, and the condenser, wherein the controller may be further configured to determine the installation state, the malfunction, and the cleaning state of the refrigerator.

The determining the installation state of the refrigerator may include measuring power of the compressor; checking whether the measured power value of the compressor is greater than a first reference value; measuring the number of revolutions of the cooling fan, when the measured power value of the compressor is greater than the first reference value; and checking whether the number of revolutions of the cooling fan is less than a second reference value.

The determining the installation state of the refrigerator may further include informing a user of a poor installation state of the refrigerator, when the measured value of the number of revolutions of the cooling fan is less than the second reference value.

The refrigerator may be provided with a machine room in which the compressor, the cooling fan, and the condenser are installed.

The controller may be further configured to determine at least one of a malfunction of the cooling fan or a cleaning state of the machine room.

The determining the malfunction and the cleaning state of the refrigerator may include calculating a performance indicator of the compressor; checking whether the performance indicator of the compressor is greater than a third reference value; measuring the number of revolutions of the cooling fan, when the performance indicator of the compressor is greater than the third reference value; checking whether the measured value of the number of revolutions of the cooling fan is greater than a fourth reference value; calculating a performance indicator of the cooling fan, when the measured value of the number of revolutions of the cooling fan is greater than the fourth reference value; and checking whether the performance indicator of the cooling fan is less than a fifth reference value.

The performance indicator of the compressor may be defined as:

$$\frac{\text{compressor power at present time}}{\text{compressor power at initial installation of refrigerator}}$$

The performance indicator of the cooling fan may be defined as:

$$\frac{\text{number of revolutions of cooling fan at present time}}{\text{number of revolutions of cooling fan at initial installation of refrigerator}}$$

The determining the malfunction and the cleaning state of the refrigerator may further include informing the user of the malfunction of the refrigerator, when the measured value of the number of revolutions of the cooling fan is less than or equal to the fourth reference value.

The determining the malfunction and the cleaning state of the refrigerator may further include informing the user that a cleaning time of the machine room has been reached, when the performance indicator of the cooling fan is less than the fifth reference value.

The determining the malfunction and the cleaning state of the refrigerator may further include predicting the cleaning time of the machine room, when the performance indicator of the cooling fan is greater than or equal to the fifth reference value.

A prediction value for the cleaning time of the machine room may be derived by learning according to an artificial intelligence model based on the performance indicator of the compressor and the performance indicator of the cooling fan.

The controller may be coupled to a processor configured to derive the prediction value. The processor may perform learning according to the artificial intelligence model, and may derive the prediction value by receiving the performance indicator of the compressor and the performance indicator of the cooling fan.

The prediction value may be a value in conditions where at least one of the performance indicator of the compressor or the performance indicator of the cooling fan is different, in a learning mode according to the artificial intelligence model.

A refrigerator according to one embodiment of the present disclosure may include a compressor, a condenser connected to the compressor, a cooling fan configured to cool the condenser, and a controller configured to control operations of the compressor, the cooling fan, and the condenser, wherein the controller may be further configured to determine an installation state of the refrigerator based on a power value of the compressor and the number of revolutions of the cooling fan provided in the refrigerator, when an operating time after initial installation of the refrigerator is less than or equal to a particular value, and determine a malfunction and a cleaning state of the refrigerator based on the power value of the compressor and the number of revolutions of the cooling fan, when the operating time after initial installation of the refrigerator exceeds the particular value.

The refrigerator may be provided with a machine room in which the compressor, the cooling fan, and the condenser are installed. The controller may be further configured to determine at least one of a malfunction of the cooling fan or a cleaning state of the machine room.

The controller may be further configured to predict a cleaning time of the machine room. A prediction value for the cleaning time of the machine room may be derived by learning according to an artificial intelligence model based on a performance indicator of the compressor and a performance indicator of the cooling fan.

According to embodiments of the present disclosure, it is possible to increase the convenience of the user by identifying the installation state of the refrigerator and informing the user when the installation state is poor, by the refrigerator itself.

According to the embodiments of the present disclosure, it is possible to increase the convenience of the user by informing the user of a malfunction of the refrigerator, by the refrigerator itself.

According to the embodiments of the present disclosure, it is possible to increase the convenience of the user by determining the cleaning time of the machine room or by predicting the cleaning time and informing the user thereof, by the refrigerator itself.

DETAILED DESCRIPTION

Figure 1:
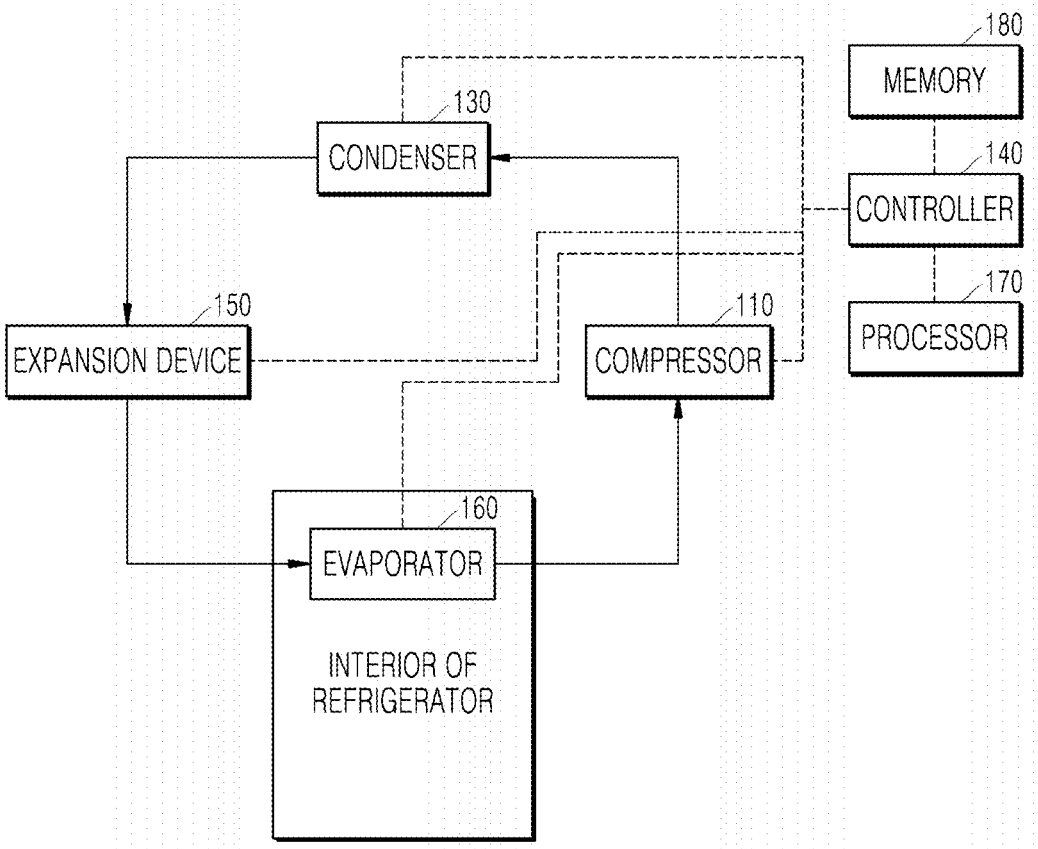
FIG. 1 is a view illustrating a refrigerator according to one embodiment.

Hereinafter, exemplary embodiments will be described in detail with reference to the accompanying drawings. The embodiments may be modified in various ways and may have various forms, and specific embodiments will be illustrated in the drawings and will be described in detail herein. However, this is not intended to limit the embodiments to the specific embodiments, and the embodiment should be understood as including all modifications, equivalents, and replacements that fall within the spirit and technical scope of the embodiments.

Although the terms "first," "second" and the like may be used to describe various elements, these components should not be limited by the terms. The terms are used to distinguish one component from the other. In addition, terms which are specially defined in consideration of the configurations and operations of the embodiments are given only to explain the embodiments and do not limit the scope of the embodiments.

In the description of the embodiment, in the case in which it is described as being formed on "on" or "under" of each element, "on" or "under" includes two elements directly contacting each other or one or more other elements being indirectly formed between the two elements. In addition, when expressed as "on" or "under", it may include not only upwards but also downwards with respect to one element.

In addition, relational terms to be described below such as "on/over/up" and "under/beneath/down" may be used to discriminate any one subject or element from another subject or element without necessarily requiring or comprehending a physical or logical relationship or sequence of subjects or elements.

Figure 2:
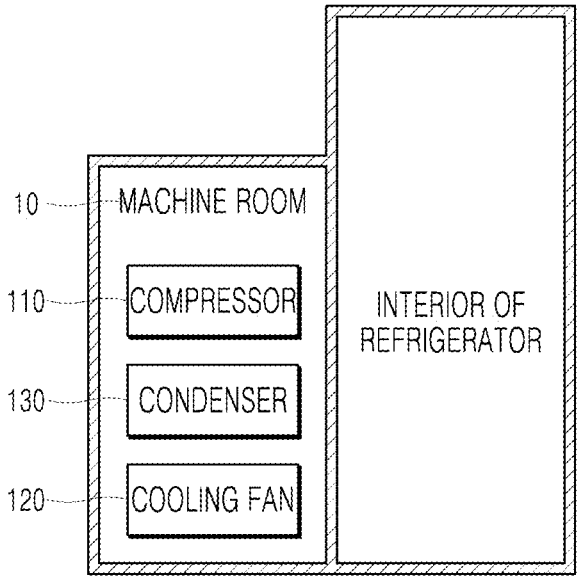
FIG. 2 is a schematic diagram illustrating a structure of the refrigerator according to one embodiment.

FIG. 1 is a view illustrating a refrigerator according to one embodiment. FIG. 2 is a schematic diagram illustrating a structure of the refrigerator according to one embodiment.

The refrigerator may be provided with a compressor 110, a condenser 130, an expansion device 150, an evaporator 160, a cooling fan 120, and a controller 140. In an embodiment according to the present disclosure, the refrigerator may bring an interior of the refrigerator (that is, an internal space of the refrigerator in which food and the like are stored) to a low-temperature state below ambient temperature, by operation of a refrigeration cycle. In an embodiment according to the present disclosure, the refrigerator may implement the refrigeration cycle using a refrigerant that undergoes a phase change.

The compressor 110, the condenser 130, the expansion device 150, and the evaporator 160 are connected through pipes. Accordingly, the refrigerant may flow through the pipes by circulating through the compressor 110, the condenser 130, the expansion device 150, and the evaporator 160.

The compressor 110 compresses the mostly gaseous refrigerant, and then discharges the compressed refrigerant at a high temperature and high pressure. The refrigerant discharged from the compressor 110 may flow into the condenser 130.

The condenser 130 is connected to the compressor 110 through the pipes, and may discharge heat of the refrigerant flowing into the condenser 130 to the outside to condense the refrigerant into a liquid. As a result, most of the refrigerant may be discharged from the condenser 130 in a liquid state.

The expansion device 150 is connected to the condenser 130 through the pipes, and may expand or throttle the refrigerant flowing from the condenser 130 to bring the refrigerant into a saturated state in which the temperature and pressure are dropped.

The evaporator 160 is connected to the expansion device 150 through the pipes and at least a portion of a surface of the evaporator 160 is disposed in the interior of refrigerator. As a result, the evaporator 160 may absorb heat from the interior of refrigerator.

The low-temperature refrigerant discharged from the expansion device 150 absorbs heat from the evaporator 160, and thus vaporization, that is, evaporation, proceeds. As a result, most of the refrigerant may be discharged from the evaporator 160 in a gaseous state, and flow back into the compressor 110.

The cooling fan 120 may be disposed to face the condenser 130, and may cool the condenser 130. That is, the cooling fan 120 may blow air into the condenser 130 to cool the refrigerant flowing in the condenser 130, thereby condensing the refrigerant into a low-temperature liquid state.

The controller 140 may be electrically connected to the compressor 110, the condenser 130, the expansion device 150, the evaporator 160, and the cooling fan 120, and may control the operations of these components. In particular, the controller 140 may operate the compressor 110 and the cooling fan 120, or stop their operations.

Meanwhile, the controller 140 may be connected to a processor 170. The processor 170 may perform learning according to an artificial intelligence model to derive, for example, a prediction value for a cleaning time of a machine room 10. Artificial intelligence model learning will be described in detail below.

Referring to FIG. 2, the refrigerator may be provided with the machine room 10. Except for the evaporator 160, which exchanges heat with the interior of refrigerator, most of the aforementioned components of the refrigerator may be provided in the machine room 10, which is separated from the interior of refrigerator.

For example, the compressor 110, the cooling fan 120, and the condenser 130 may be installed in the machine room 10. In addition, the expansion device 150 may also be provided in the machine room 10, according to the structure of the refrigerator.

Considering the function and structure of the refrigerator, the machine room 10 may be provided as a relatively small space. The above-described components, pipes connecting these components, and wires for supplying power to these components or communicating with the controller 140 may be arranged in the small space of the machine room 10.

Thus, the machine room 10 may be very complicated in structure. In addition, as the cooling fan 120 operates, foreign substances, such as dust or the like, may be actively introduced by the cooling fan 120 into the machine room 10 with the complicated structure.

The introduced foreign substances may accumulate in large quantity in the machine room 10 with the complicated structure. In particular, the foreign substances may accumulate in large quantity on the wing surface of the cooling fan 120, the surface of the condenser 130 in which cooling fins are formed, and the surfaces of the pipes and the wires.

The foreign substances accumulated in the machine room 10 may increase an occurrence of fire and reduce the performance of the refrigerator.

For example, the foreign substances accumulated in the machine room 10 may cause a tracking phenomenon, which may cause a fire. The tracking phenomenon means that an electric current flows along the surface of the foreign substances accumulated in the electric product, and an electric short occurs in this part, which causes the fire.

The foreign substances accumulated in the machine room 10 may scatter during operation of the cooling fan 120, and thereby increase a flow resistance of air. In addition, due to the increase in the flow resistance of air, the number of revolutions of the cooling fan 120 having constant power consumption may be reduced. Due to the reduction in the number of revolutions of the cooling fan 120, a cooling performance of the condenser 130 may be reduced.

In addition, due to the structure in which the cooling fins are formed, the foreign substances accumulate in large quantity on the surface of the condenser 130. Such foreign substances may prevent heat exchange between the condenser 130 and the outside, thereby reducing the cooling performance of the condenser 130.

Due to the reduction in the cooling performance of the condenser 130, a temperature of the refrigerant in the condenser 130 may increase overall. When the temperature of the refrigerant in the condenser 130 increases, a pressure of the refrigerant also increases.

Accordingly, the compressor 110 needs to do more work in order to increase the temperature and pressure of the refrigerant flowing into the condenser 130. As a result, power of the compressor 110, that is, the power consumption of the compressor 110, increases.

Therefore, in order to suppress the occurrence of fire and to suppress the reduction in the performance of the refrigerator, cleaning of the machine room 10 is necessary. According to one embodiment of the present disclosure, a refrigerator diagnosis method that includes determining a cleaning state of the machine room 10 and informing a user of a cleaning time of the machine room 10, or predicting a cleaning time of the machine room 10, is provided.

Further, according to one embodiment of the present disclosure, a refrigerator diagnostic method that includes identifying operating states of the compressor 110 and the cooling fan 120 and informing the user of a malfunction of the refrigerator based on the identified operating states is provided.

The refrigerator may operate normally in a proper installation state. For example, the machine room 10 of the refrigerator may be suitably installed so as to have a separation distance from an outer wall surface that is greater than a predetermined distance. The manufacturer of the refrigerator may provide the user with a guide on such separation distance.

When the separation distance between the refrigerator and the outer wall surface is closer than the distance according to the guide, the performance of the refrigerator may be reduced. For example, when the separation distance is closer than the distance according to the guide, poor heat dissipation of the condenser 130 may occur, or the performance of the cooling fan 120 may deteriorate. This phenomenon may have a tendency similar to the case where the foreign substances are accumulated in the machine room 10.

When the separation distance is closer than the distance according to the guide, the heat discharged from the condenser 130 is not smoothly discharged to the outside of the machine room 10. As a result, poor heat dissipation of the condenser 130 may occur as compared with normal operation.

Due to the poor heat dissipation of the condenser 130, the work of the compressor 110 is increased, thereby increasing the power of the compressor 110, as described above.

In addition, when the separation distance is closer than the distance according to the guide, a degree of blockage of the machine room 10 increases, such that it is difficult for air to smoothly enter and exit the machine room 10. As a result, due to the increase in the flow resistance of air, the number of revolutions of the cooling fan 120 having constant power consumption may be reduced. Due to the reduction in the number of revolutions of the cooling fan 120, the cooling performance of the condenser 130 may be reduced.

Thus, according to one embodiment of the present disclosure, a refrigerator diagnostic method that includes measuring the number of revolutions of the cooling fan 110 and power of the compressor 110, and determining an installation state of the refrigerator based on the measured values, is provided.

Figure 3:
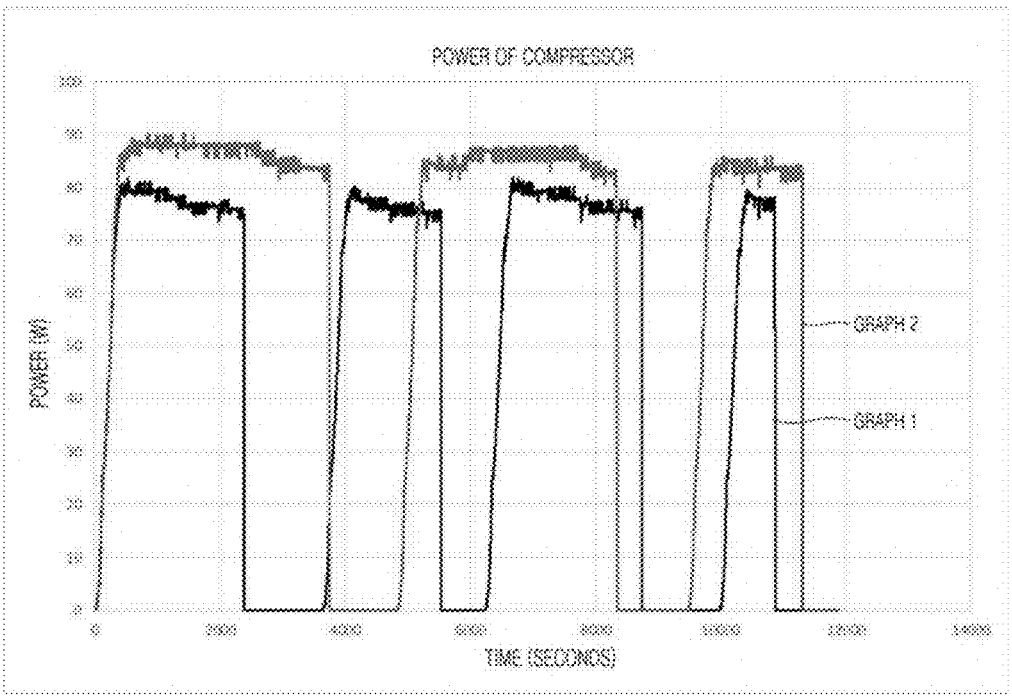
FIG. 3 is a graph showing a change in power of a compressor over time, according to one embodiment.

FIG. 3 is a graph showing a change in power of a compressor over time, according to one embodiment. In FIG. 3, results of testing the change of power in the compressor 110 of the refrigerator which is installed and used for a long time are shown graphically.

In FIG. 3, the vertical axis represents power of the compressor 110 in watts (W), and the horizontal axis represents use time of the refrigerator in seconds.

According to one embodiment of the present disclosure, a magnitude of the work performed by the compressor 110 may vary with time, in order to satisfy a cooling capacity set for each refrigerator. Accordingly, the power (power consumption) of the compressor 110 may also vary. In addition, as shown in FIG. 3, the compressor 110 may operate intermittently, that is, the compressor 110 may operate and then stop, and then operate again.

Graph 1 shows the power of the compressor 110 when the cleaning state of the machine room 10 is good, and graph 2 shows the power of the compressor 110 when the cleaning state of the machine room 10 is poor and the machine room 10 needs cleaning.

It may be seen that when the cleaning state of the machine room 10 is poor, an operating time of the compressor 110 is long and the power of the compressor 110 is high during the operating time, as compared with the case where the cleaning state is good. Therefore, when the cleaning state of the machine room 10 is poor, the power of the compressor 110 increases overall, as compared with the case where the cleaning state is good.

As described above, when the cleaning state of the machine room 10 is poor, heat dissipation in the condenser 130 is poor, and the temperature and pressure of the refrigerant increase. Accordingly, the compressor 110 needs to do more work in order to increase the temperature and pressure of the refrigerant flowing into the condenser 130. As a result, the power of the compressor 110, that is, the power consumption of the compressor 110, increases.

Figure 4:
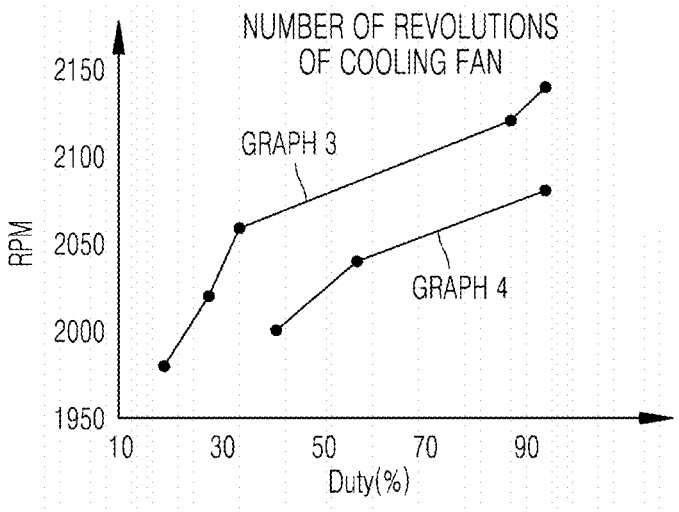
FIG. 4 is a graph showing a change in the number of revolutions of a cooling fan according to duty, according to one embodiment.

FIG. 4 is a graph showing a change in the number of revolutions of a cooling fan according to duty, according to one embodiment. In FIG. 4, results of testing the change of the number of revolutions in the cooling fan 120 of the refrigerator which is installed and used for a long time are shown graphically.

According to one embodiment of the present disclosure, the cooling fan 120 has a generally constant power consumption, that is, rated power, at which the number of revolutions may vary.

In FIG. 4, the vertical axis represents the number of revolutions of the cooling fan 120 in RPM, and the horizontal axis represents the duty of the cooling fan 120 in percentage (%). Since the cooling fan 120 also operates intermittently, an operating time of the cooling fan 120 may be represented as the duty.

The duty means a ratio of the operating time of the cooling fan 120 to the total time. For example, when the cooling fan 120 operates for 30 minutes and stops for 30 minutes of the total time of 1 hour, the duty of the cooling fan 120 is 50%. As may be seen in FIG. 4, as the duty increases, the number of revolutions of the cooling fan 120 may increase.

Graph 3 shows the number of revolutions of the cooling fan 120 when the cleaning state of the machine room 10 is good, and graph 4 shows the number of revolutions of the cooling fan 120 when the cleaning state of the machine room 10 is poor and the machine room 10 needs cleaning.

As shown in FIG. 4, it may be seen that when the cleaning state of the machine room 10 is poor, the number of revolutions of the cooling fan 120 is small at the same duty, as compared with the case where the cleaning state is good.

As described above, when the cleaning state of the machine room 10 is poor, the foreign substances accumulated in the machine room 10 may scatter during operation of the cooling fan 120, and thereby increase flow resistance of air. In addition, due to the increase in the flow resistance of air, the number of revolutions of the cooling fan 120 having constant power consumption may be reduced.

Reviewing with reference to FIGS. 3 and 4, it may be seen that when the cleaning state of the machine room 10 is poor, the power of the compressor 110 increases and the number of revolutions of the cooling fan 120 is reduced. Thus, according to one embodiment of the present disclosure, when the power of the compressor 110 is measured and the measured value is greater than a predetermined reference value, and when the number of revolutions of the cooling fan 120 is measured and the measured value is less than a predetermined reference value, it may be determined that the machine room 10 is in a state of poor cleaning.

Figure 5:
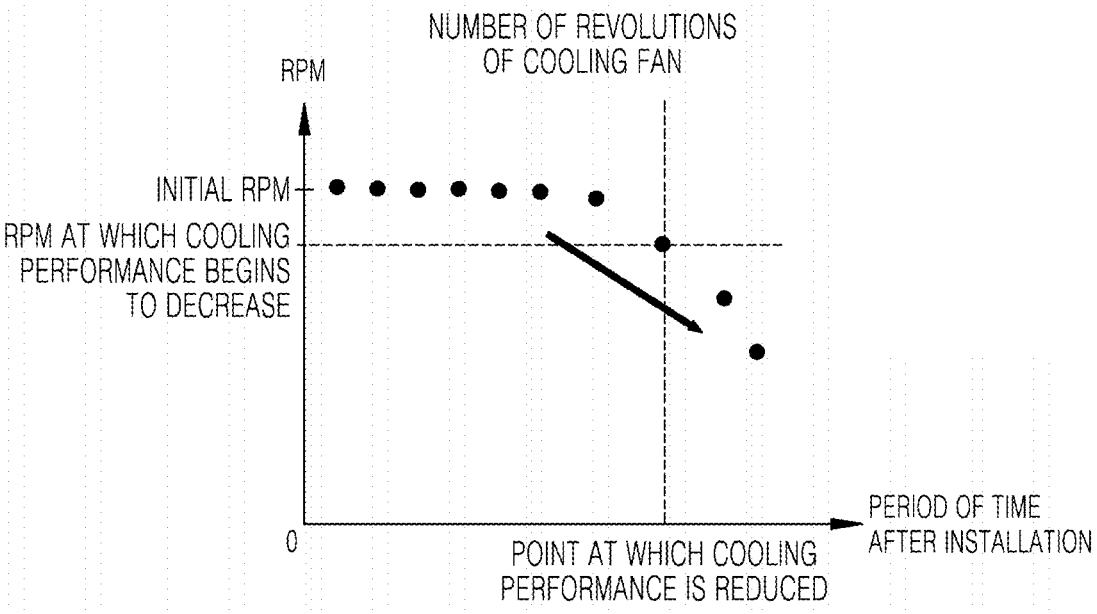
FIG. 5 is a graph showing a change in the number of revolutions of a cooling fan over a period of time after installation of the refrigerator, according to one embodiment.
Figure 6:
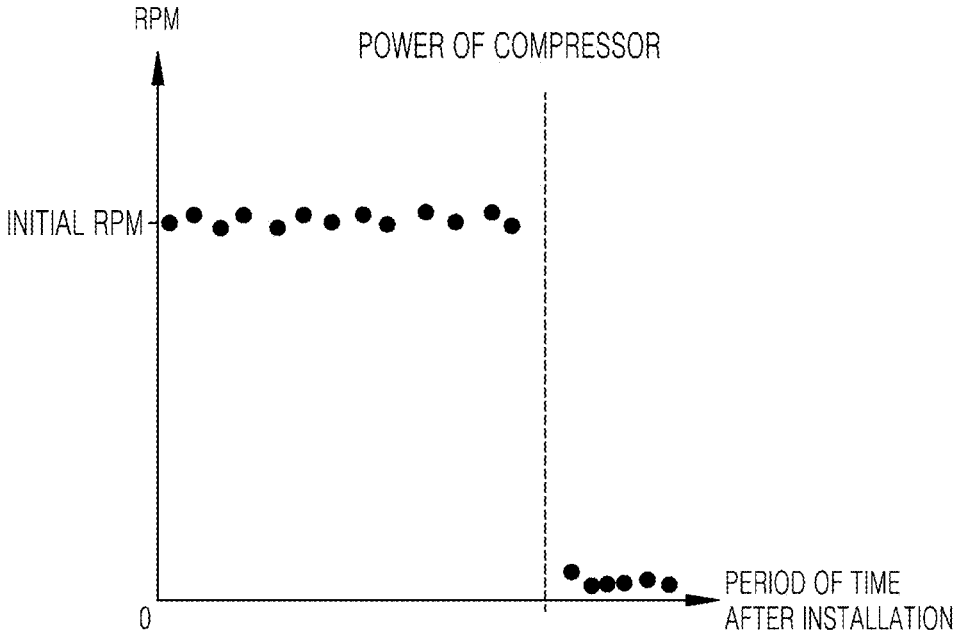
FIG. 6 is a graph showing a change in the number of revolutions of a cooling fan over a period of time after installation of the refrigerator, according to another embodiment.

FIG. 5 is a graph showing a change in the number of revolutions of a cooling fan over a period of time after installation of the refrigerator, according to one embodiment. In FIG. 5 and FIG. 6 described below, the vertical axis represents the number of revolutions of the cooling fan 120 in RPM, and the horizontal axis represents a period of time after installation of the refrigerator.

Referring to FIG. 5, when the refrigerator operates for a long time, as foreign substances accumulate in the machine room 10, the number of revolutions of the cooling fan 120 may be reduced, as shown by an arrow.

That is, it may be seen that the cooling fan 120 operates stably at an initial RPM, but as the foreign substances accumulate in the machine room 10, the RPM is gradually reduced. At this time, when the RPM at which the cooling performance begins to decrease and the point at which the cooling performance is reduced are reached, cleaning of the machine room 10 is required.

FIG. 6 is a graph showing a change in the number of revolutions of a cooling fan over a period of time after installation of the refrigerator, according to another embodiment.

In FIG. 6, it may be seen that when the period of time after installation exceeds a hidden line, the number of revolutions of the cooling fan 120 is drastically reduced to or near zero. This means that the cooling fan 120 has stopped operating due to disconnection of the power cable or the like, or the number of revolutions has drastically reduced.

Therefore, it is possible to identify a malfunction due to disconnection of the cooling fan 120 or the like, by identifying a drastic reduction in the number of revolutions of the cooling fan 120.

Reviewing with reference to FIGS. 5 and 6, when the number of revolutions of the cooling fan 120 is less than a predetermined reference value, it may be determined that the cooling fan 120 is malfunctioning or that the machine room 10 is in a state of poor cleaning.

Figure 7:
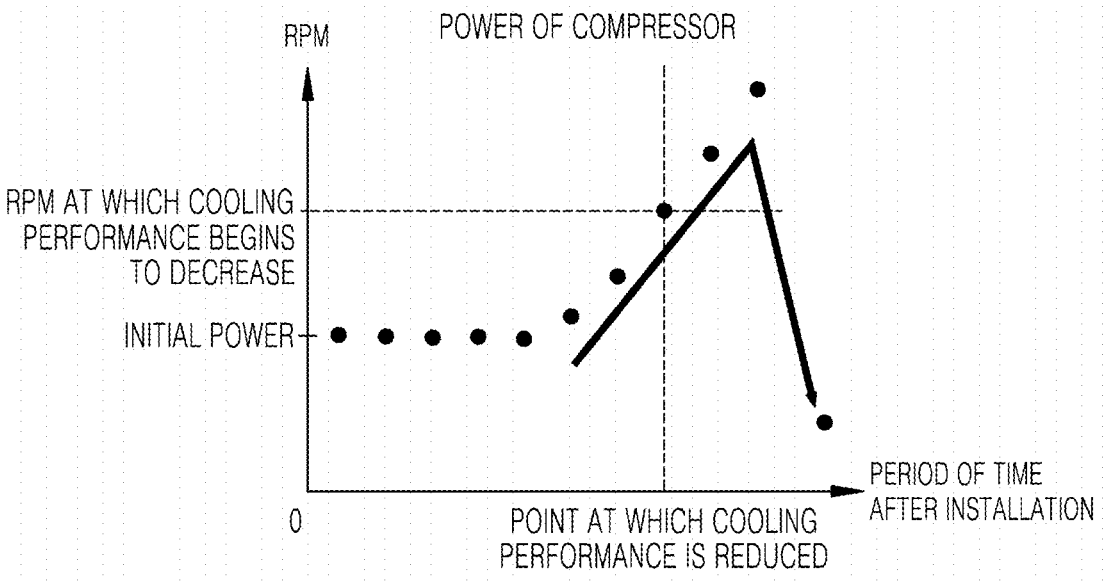
FIG. 7 is a graph showing a change in power of a compressor over a period of time after installation of the refrigerator, according to one embodiment.
Figure 8:
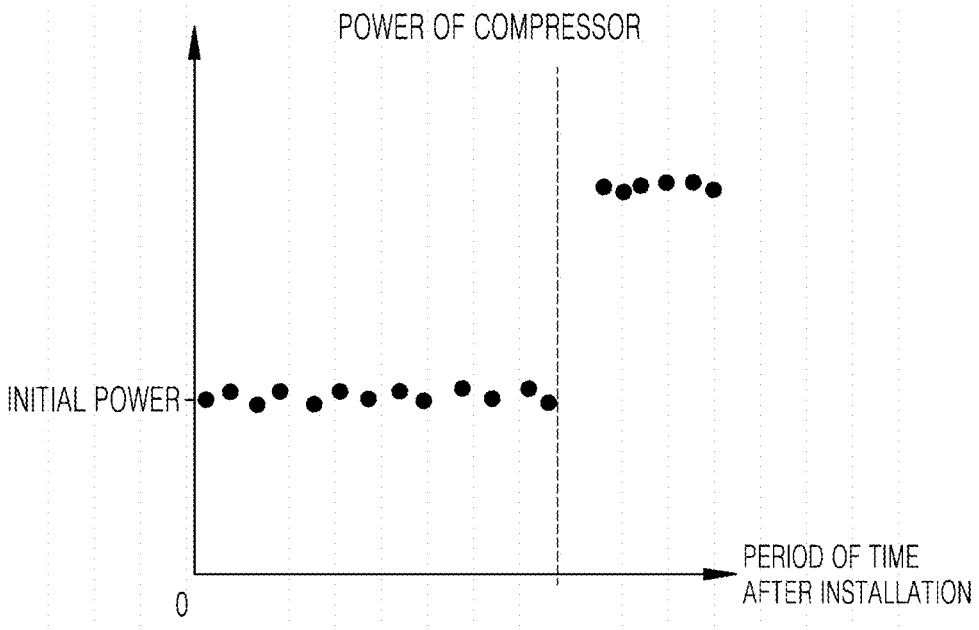
FIG. 8 is a graph showing a change in power of a compressor over a period of time after installation of the refrigerator, according to another embodiment.

FIG. 7 is a graph showing a change in power of a compressor 110 over a period of time after installation of the refrigerator, according to one embodiment. In FIG. 7 and FIG. 8 described below, the vertical axis represents power of the compressor 110 and the horizontal axis represents a period of time after installation of the refrigerator.

Referring to FIG. 7, when the refrigerator operates for a long time, as foreign substances accumulate in the machine room 10, power of the compressor 110 may increase, as shown by an arrow.

That is, it may be seen that the compressor 110 operates stably at an initial power, but as foreign substances accumulate in the machine room 10, the power gradually increases. At this time, when the power at which the cooling performance begins to decrease and the cooling performance reduction time point are reached, cleaning of the machine room 10 is required.

It may be seen that when the power of the compressor 110 increases and reaches a certain point, the power of the compressor 110 is drastically reduced, as shown by the arrow.

This means that as the power of compressor 110 continues to increase and the compressor 110 becomes overloaded, the compressor 110 is tripped to stop operation of the compressor 110 in order to protect a motor provided in the compressor 110.

FIG. 8 is a graph showing a change in power of a compressor 110 over a period of time after installation of the refrigerator, according to another embodiment.

In FIG. 8, it may be seen that when the period of time after installation exceeds a hidden line, the power of the compressor 110 drastically increases and maintains a substantially constant value. This means that the cooling fan 120 has stopped operating due to disconnection of the power cable or the like, or the number of revolutions has drastically reduced.

That is, since the cooling fan 120 is not operating, the temperature and pressure of the condenser 130 are rapidly increased, and accordingly, the work of the compressor 110 is increased to cope with the increased temperature and pressure of the condenser 130. That is, due to poor heat dissipation of the condenser 130, the work of the compressor 110 is increased, thereby increasing the power of the compressor 110, as described above.

Reviewing with reference to FIGS. 7 and 8, when the power of the compressor 110 is greater than a predetermined reference value, it may be determined that the cooling fan 120 is malfunctioning or that the machine room 10 is in a state of poor cleaning.

Based on the results discussed above, the refrigerator diagnostic method will now be described in detail.

According to one embodiment of the present disclosure, a controller may determine an installation state, a malfunction, and a cleaning state of the refrigerator.

To this end, the controller 140 may measure power of the compressor 110 and the number of revolutions of the cooling fan 120. For example, the controller 140 may measure the power of the compressor 110 and the number of revolutions of the cooling fan 120 by means of sensors provided in the compressor 110 and the cooling fan 120. In this regard, since this is a technical matter obvious to a person skilled in the art, a detailed description thereof will be omitted.

According to one embodiment of the present disclosure, the controller 140 may determine the installation state of the refrigerator based on a power value of the compressor 110 provided in the refrigerator and the number of revolutions of the cooling fan 120 provided in the refrigerator, when an operating time after initial installation of the refrigerator is less than or equal to a particular value.

According to one embodiment of the present disclosure, the controller 140 may determine the malfunction and the cleaning state of the refrigerator based on the power value of the compressor 110 and the number of revolutions of the cooling fan 120, when the operating time after initial installation of the refrigerator exceeds the particular value.

Figure 9:
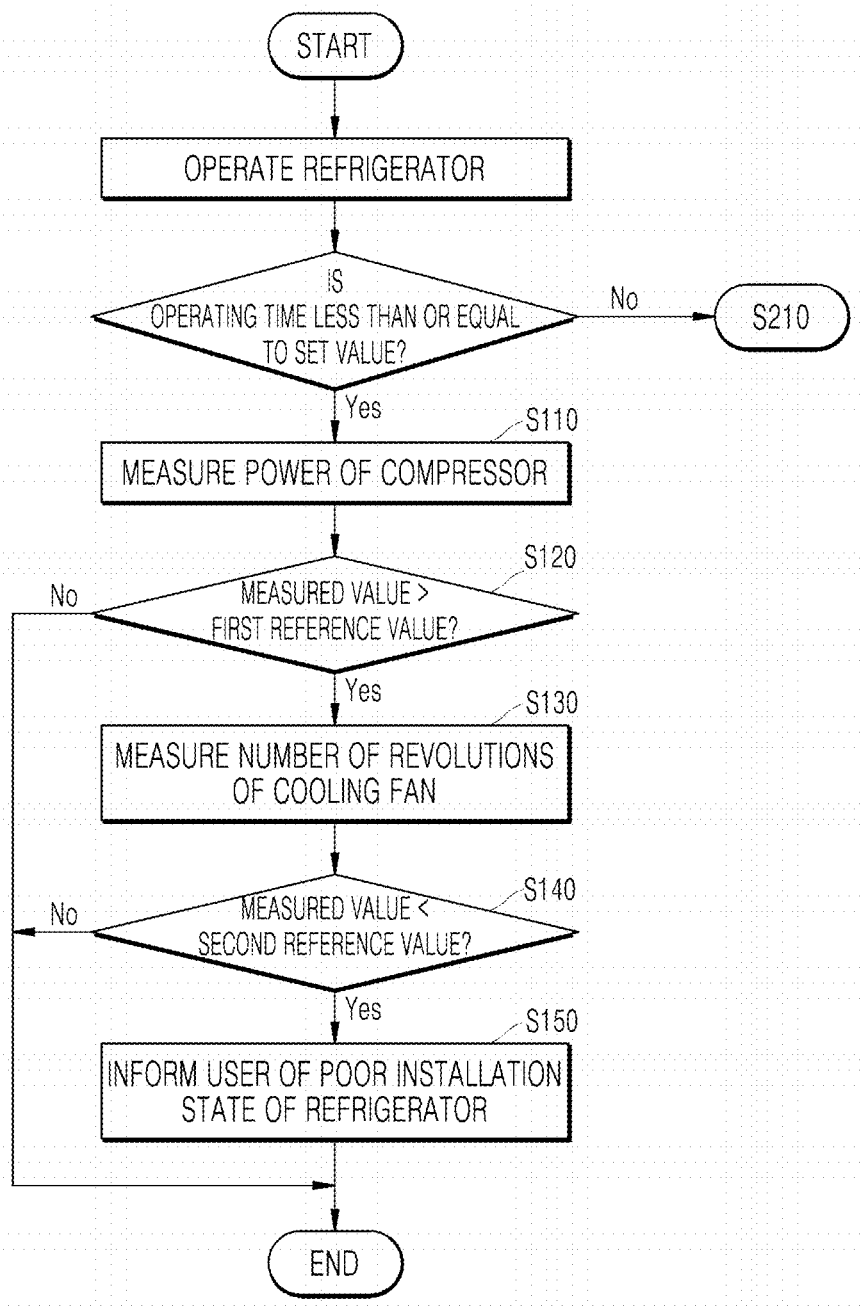
FIG. 9 is a flowchart illustrating a refrigerator diagnostic method according to one embodiment.

FIG. 9 is a flowchart illustrating a refrigerator diagnostic method according to one embodiment. FIG. 9 illustrates a method of determining an installation state of the refrigerator.

When the operating time after initial installation of the refrigerator is less than or equal to a particular value, the controller 140 may measure power of the compressor 110 (S110). First, it may be determined whether the refrigerator is properly installed as guided by the manufacturer, after initial installation of the refrigerator.

In this case, the manufacturer's guide may relate to, for example, installing the machine room 10 of the refrigerator to have a separation distance from the outer wall surface that is greater than a predetermined distance. The particular value may be, for example, an operating time of the refrigerator of 3 days (72 hours) or 4 days (96 hours) after initial installation, but is not limited thereto.

The controller 140 may check whether the measured power value of the compressor 110 is greater than a first reference value (S120).

The first reference value may be a criterion for determining whether the refrigerator is properly installed according to the guide, for example, whether the refrigerator is installed to have a predetermined separation distance from the outer wall surface, and may be properly acquired and set through experimentation.

When the measured power value is less than or equal to the first reference value, it may be determined that the refrigerator is properly installed according to the guide. When the measured power value is greater than the first reference value, it may be determined that the refrigerator is not installed according to the guide. As a result, there is a possibility of poor installation.

When the measured power value of the compressor 110 is greater than the first reference value, the controller 140 may measure the number of revolutions of the cooling fan 120 (S130).

The controller 140 may check whether the measured value of the number of revolutions of the cooling fan 120 is less than a second reference value (S140).

The second reference value may be a criterion for determining whether the refrigerator is properly installed according to the guide, for example, whether the refrigerator is installed to have a predetermined separation distance from the outer wall surface, and may be properly acquired and set through experimentation.

When the measured value of the number of revolutions is greater than or equal to the second reference value, it may be determined that the refrigerator is properly installed according to the guide. When the measured value of the number of revolutions is less than the second reference value, it may be determined that the refrigerator is not installed according to the guide. As a result, the controller 140 may determine that there is a possibility of poor installation of the refrigerator.

When the measured value of the number of revolutions of the cooling fan 120 is less than the second reference value, the controller 140 may inform a user of a poor installation state of the refrigerator (S150). The controller 140 may inform the user of the poor installation state of the refrigerator through sound, voice, text, or the like.

The refrigerator may be provided with a means configured to inform the user of the installation state of the refrigerator, such as a speaker, a display for outputting text, and the like, connected to the controller 140.

The user may receive a notification from the controller 140 that the installation state of the refrigerator is poor, and may take necessary measures such as reinstalling the refrigerator or the like.

Figure 10:
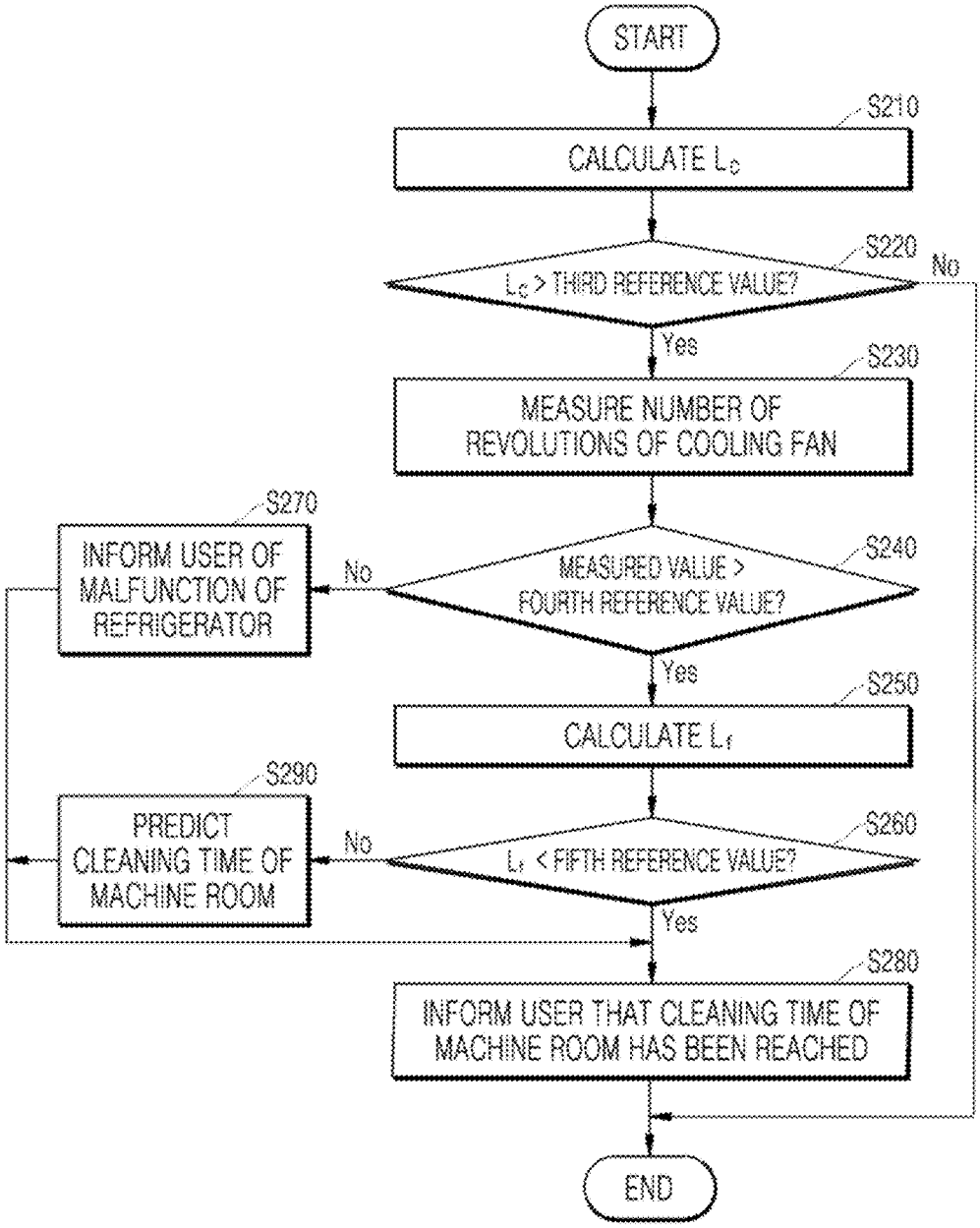
FIG. 10 is a flowchart illustrating a refrigerator diagnostic method according to another embodiment.

FIG. 10 is a flowchart illustrating a refrigerator diagnostic method according to another embodiment. FIG. 10 illustrates a method of determining a malfunction and a cleaning state of the refrigerator. The controller 140 may determine at least one of a malfunction of the cooling fan 120 or a cleaning state of the machine room 10.

When an operating time after initial installation of the refrigerator is greater than a particular value, the controller 140 may calculate a performance indicator Lc of the compressor (S210). At this time, the particular value is as described above.

The performance indicator Lc of the compressor may be defined as follows:

$$Lc = \frac{\text{compressor power at present time}}{\text{compressor power at initial installation of refrigerator}}$$

The performance indicator Lc of the compressor tends to be similar to the power of the compressor 110 described above with reference to FIGS. 3, 7 and 8. The performance indicator Lc of the compressor is a dimensionless value introduced for diagnostic use across different models of refrigerators, for example, refrigerators with different cooling capacities.

The controller 140 may check whether the performance indicator Lc of the compressor is greater than a third reference value (S220).

The third reference value may be a criterion for determining whether the refrigerator is operating normally and without problem, that is, whether the refrigerator is operating without malfunction and without poor cleaning of the machine room 10 being a problem, and may be properly acquired and set through experimentation.

When the measured performance indicator Lc of the compressor is less than or equal to the third reference value, it may be determined that the refrigerator is operating normally, without any malfunction or problem of poor cleaning of the machine room 10. When the measured performance indicator Lc of the compressor is greater than the third reference value, the refrigerator may be in a situation in which malfunction has occurred or poor cleaning of the machine room 10 is a problem.

When the performance indicator Lc the compressor 110 is greater than the third reference value, the controller 140 may measure the number of revolutions of the cooling fan 120 (S230).

The controller 140 may check whether the measured value of the number of revolutions of the cooling fan 120 is greater than a fourth reference value (S240).

The fourth reference value may be a criterion for determining, as the refrigerator operates for a long time, whether malfunction of the refrigerator has occurred, for example, whether the cooling fan 120 has stopped operating due to disconnection of a power cable or the like, or whether the number of revolutions of the cooling fan 120 is drastically reduced, and may be properly acquired and set through experimentation.

Of course, the fourth reference value is related to a case in which the cooling fan 120 has stopped due to failure or the number of revolutions is drastically reduced. Therefore, the fourth reference value may be relatively smaller than the second reference value, which is set in a state where the cooling fan 120 has not failed.

When the measured value of the number of revolutions of the cooling fan 120 is less than or equal to the fourth reference value, the controller 140 may determine that the cooling fan 120 has failed due to cable disconnection or the like, and thus that the refrigerator is in a state of malfunction.

When the measured value of the number of revolutions of the cooling fan 120 is less than or equal to the fourth reference value, the user may be informed of the malfunction of the refrigerator (S270). The controller 140 may inform the user of the malfunction of the refrigerator through sound, voice, text, or the like.

The user may receive a notification that the refrigerator is in the state of malfunction from the controller 140, and may take necessary measures, such as repairing the cooling fan 120 or the like.

When the measured value of the number of revolutions of the cooling fan 120 is greater than the fourth reference value, the controller 140 may calculate a performance indicator Lf of the cooling fan (S250).

The performance indicator Lf of the cooling fan may be defined as follows:

$$Lf = \frac{\text{number of revolutions of cooling fan at present time}}{\text{number of revolutions of cooling fan at initial installation of refrigerator}}$$

The performance indicator Lf of the cooling fan tends to be similar to the number of revolutions of the cooling fan 120 described above with reference to FIGS. 4 to 6. The performance indicator Lf of the cooling fan is a dimensionless value introduced for diagnostic use across different models of refrigerators, for example, refrigerators with different cooling capacities.

The controller 140 may check whether the performance indicator Lf of the cooling fan is less than a fifth reference value (S260).

The fifth reference value may be a criterion for determining whether a cleaning time of the machine room 10 has been reached. That is, when the performance indicator Lf of the cooling fan is less than the fifth reference value, the controller 140 may determine that the cleaning time of the machine room 10 has been reached. In addition, when the performance indicator Lf of the cooling fan is greater than or equal to the fifth reference value, the controller 140 may predict the cleaning time of the machine room 10. The fifth reference value may be properly acquired and set through experimentation.

When the performance indicator Lf of the cooling fan is less than the fifth reference value, the controller 140 may inform the user that the cleaning time of the machine room 10 has been reached (S280). The controller 140 may inform the user that the cleaning time of the machine room 10 has been reached through sound, voice, text, or the like.

The user may be informed by the controller 140 that the cleaning time of the machine room 10 has been reached, and may clean the machine room 10 to allow the refrigerator to operate normally.

When the performance indicator Lf of the cooling fan is greater than or equal to the fifth reference value, the cleaning time of the machine room 10 may be predicted (S290). The controller 140 may predict how many hours after the present time the machine room 10 should be cleaned.

The controller 140 may inform the user of the prediction value for the cleaning time of the machine room 10 through sound, voice, text, or the like. In response to the notification from the controller 140, the user may take necessary measures, such as cleaning the machine room 10 or the like, before the predicted cleaning time is reached.

The prediction value for the cleaning time of the machine room 10 may be derived by learning according to an artificial intelligence model, based on the performance indicator Lc of the compressor and the performance indicator Lf of the cooling fan. Hereinafter, the artificial intelligence model will be described below.

Artificial intelligence (AI) is a field of computer engineering science and information technology that studies methods to make computers mimic intelligent human behaviors such as reasoning, learning, self-improving, and the like.

In addition, AI does not exist on its own, but is rather directly or indirectly related to a number of other fields in computer science. Particularly in recent years, there have been numerous attempts to introduce an element of AI into various fields of information technology to solve problems of the respective fields.

Machine learning is an area of artificial intelligence that includes the field of study that gives computers the capability to learn without being explicitly programmed.

More specifically, machine learning is a technology that investigates and builds systems, and algorithms for such systems, that are capable of learning, making predictions, and enhancing its own performance on the basis of experiential data. Machine learning algorithms, rather than only executing rigidly set static program commands, may be used to take an approach that builds models for deriving predictions and decisions from inputted data.

Numerous machine learning algorithms have been developed for data classification in machine learning. Representative examples of such machine learning algorithms for data classification include a decision tree, a Bayesian network, a support vector machine (SVM), an artificial neural network (ANN), and so forth.

Decision tree refers to an analysis method that uses a tree-like graph or model of decision rules to perform classification and prediction.

Bayesian network may include a model that represents the probabilistic relationship (conditional independence) among a set of variables. Bayesian network may be appropriate for data mining via unsupervised learning.

SVM may include a supervised learning model for pattern detection and data analysis, heavily used in classification and regression analysis.

ANN is a data processing system modelled after the mechanism of biological neurons and interneuron connections, in which a number of neurons, referred to as nodes or processing elements, are interconnected in layers.

ANNs are models used in machine learning and may include statistical learning algorithms conceived from biological neural networks (particularly of the brain in the central nervous system of an animal) in machine learning and cognitive science.

ANNs may refer generally to models that has artificial neurons (nodes) forming a network through synaptic interconnections, and acquires problem-solving capability as the strengths of synaptic interconnections are adjusted throughout training.

The terms 'artificial neural network' and 'neural network' may be used interchangeably herein.

An ANN may include a number of layers, each including a number of neurons. Furthermore, the ANN may include synapses that connect the neurons to one another.

An ANN may be defined by the following three factors: (1) a connection pattern between neurons on different layers; (2) a learning process that updates synaptic weights; and (3) an activation function generating an output value from a weighted sum of inputs received from a previous layer.

ANNs include, but are not limited to, network models such as a deep neural network (DNN), a recurrent neural network (RNN), a bidirectional recurrent deep neural network (BRDNN), a multilayer perception (MLP), and a convolutional neural network (CNN).

An ANN may be classified as a single-layer neural network or a multi-layer neural network, based on the number of layers therein.

In general, a single-layer neural network may include an input layer and an output layer.

In general, a multi-layer neural network may include an input layer, one or more hidden layers, and an output layer.

The input layer receives data from an external source, and the number of neurons in the input layer is identical to the number of input variables. The hidden layer is located between the input layer and the output layer, and receives signals from the input layer, extracts features, and feeds the extracted features to the output layer. The output layer receives a signal from the hidden layer and outputs an output value based on the received signal. Input signals between the neurons are summed together after being multiplied by corresponding connection strengths (synaptic weights), and if this sum exceeds a threshold value of a corresponding neuron, the neuron may be activated and output an output value obtained through an activation function.

A deep neural network with a plurality of hidden layers between the input layer and the output layer may be the most representative type of artificial neural network which enables deep learning, which is one machine learning technique.

The artificial neural network may be trained using training data. Here, the training may refer to the process of determining parameters of the artificial neural network by using the training data, to perform tasks such as classification, regression analysis, and clustering of inputted data. Such parameters of the artificial neural network may include synaptic weights and biases applied to neurons.

The artificial neural network trained using training data may classify or cluster inputted data according to a pattern within the inputted data.

Throughout the present specification, the artificial neural network trained using training data may be referred to as a trained model.

Hereinbelow, learning paradigms of the artificial neural network will be described in detail.

Learning paradigms, in which the artificial neural network operates, may be classified into supervised learning, unsupervised learning, semi-supervised learning, and reinforcement learning.

Supervised learning is a machine learning method that derives a single function from the training data.

Among the functions that may be thus derived, a function that outputs a continuous range of values may be referred to as a regressor, and a function that predicts and outputs the class of an input vector may be referred to as a classifier.

In supervised learning, the artificial neural network may be trained with training data that has been given a label.

Here, the label may refer to a target answer (or a result value) to be guessed by the artificial neural network when the training data is inputted to the artificial neural network.

Throughout the present specification, the target answer (or a result value) to be guessed by the artificial neural network when the training data is inputted may be referred to as a label or labeling data.

Throughout the present specification, assigning one or more labels to training data in order to train the artificial neural network may be referred to as labeling the training data with labeling data.

Training data and label corresponding to the training data together may form a single training set and as such, they may be inputted to the artificial neural network as a training set.

The training data may exhibit a number of features, and the training data being labeled with the labels may be interpreted as the features exhibited by the training data being labeled with the labels. In this case, the training data may represent a feature of an input object as a vector.

Using training data and labeling data together, the artificial neural network may derive a correlation function between the training data and the labeling data. Then, through evaluation of the function derived from the artificial neural network, a parameter of the artificial neural network may be determined (optimized).

Unsupervised learning is a machine learning method that learns from training data that has not been given a label.

More specifically, unsupervised learning may be a training scheme that trains the artificial neural network to discover a pattern within given training data and perform classification by using the discovered pattern, rather than by using a correlation between given training data and labels corresponding to the given training data.

Examples of unsupervised learning include, but are not limited to, clustering and independent component analysis.

Examples of artificial neural networks using unsupervised learning include, but are not limited to, a generative adversarial network (GAN) and an autoencoder (AE).

GAN is a machine learning method in which two different artificial intelligences, a generator and a discriminator, improve performance through competing with each other.

The generator may be a model generating new data that generate new data based on true data.

The discriminator may be a model recognizing patterns in data that determines whether inputted data is from the true data or from the new data generated by the generator.

Furthermore, the generator may receive and learn from data that has failed to fool the discriminator, while the discriminator may receive and learn from data that has succeeded in fooling the discriminator. Accordingly, the generator may evolve so as to fool the discriminator as effectively as possible, while the discriminator evolves so as to distinguish, as effectively as possible, between the true data and the data generated by the generator.

An auto-encoder (AE) is a neural network which aims to reconstruct its input as output.

More specifically, AE may include an input layer, at least one hidden layer, and an output layer.

Since the number of nodes in the hidden layer is less than the number of nodes in the input layer, the dimensionality of data is reduced, thus leading to data compression or encoding.

Furthermore, the data outputted from the hidden layer may be inputted to the output layer. Given that the number of nodes in the output layer is greater than the number of nodes in the hidden layer, the dimensionality of the data increases, thus leading to data decompression or decoding.

Furthermore, in the AE, the inputted data is represented as hidden layer data as interneuron connection strengths are adjusted through training. The fact that when representing information, the hidden layer is able to reconstruct the inputted data as output by using fewer neurons than the input layer may indicate that the hidden layer has discovered a hidden pattern in the inputted data and is using the discovered hidden pattern to represent the information.

Semi-supervised learning is machine learning method that makes use of both labeled training data and unlabeled training data.

One semi-supervised learning technique involves reasoning the label of unlabeled training data, and then using this reasoned label for learning. This technique may be used advantageously when the cost associated with the labeling process is high.

Reinforcement learning may be based on a theory that given the condition under which a reinforcement learning agent may determine what action to choose at each time instance, the agent may find an optimal path to a solution solely based on experience without reference to data.

Reinforcement learning may be performed mainly through a Markov decision process.

Markov decision process consists of four stages: first, an agent is given a condition containing information required for performing a next action; second, how the agent behaves in the condition is defined third, which actions the agent should choose to get rewards and which actions to choose to get penalties are defined; and fourth, the agent iterates until future reward is maximized, thereby deriving an optimal policy.

The artificial neural network is characterized by features of its model, the features including an activation function, a loss function or cost function, a learning algorithm, an optimization algorithm, and so forth. Also, the hyperparameters are set before learning, and model parameters may be set through learning to specify the architecture of the artificial neural network.

For instance, the structure of the artificial neural network may be determined by a number of factors, including the number of hidden layers, the number of hidden nodes included in each hidden layer, input feature vectors, target feature vectors, and so forth.

Hyperparameters may include various parameters which need to be initially set for learning, much like the initial values of model parameters. Also, the model parameters may include various parameters sought to be determined through learning.

For instance, the hyperparameters may include initial values of weights and biases between nodes, mini-batch size, iteration number, learning rate, and so forth. Furthermore, the model parameters may include a weight between nodes, a bias between nodes, and so forth.

Loss function may be used as an index (reference) in determining an optimal model parameter during the learning process of the artificial neural network. Learning in the artificial neural network involves a process of adjusting model parameters so as to reduce the loss function, and the purpose of learning may be to determine the model parameters that minimize the loss function.

Loss functions typically may use means squared error (MSE) or cross entropy error (CEE), but the present disclosure is not limited thereto.

Cross-entropy error may be used when a true label is one-hot encoded. One-hot encoding may include an encoding method in which among given neurons, only those corresponding to a target answer are given 1 as a true label value, while those neurons that do not correspond to the target answer are given 0 as a true label value.

In machine learning or deep learning, learning optimization algorithms may be deployed to minimize a cost function and examples of such learning optimization algorithms include gradient descent (GD), stochastic gradient descent (SGD), momentum, Nesterov accelerate gradient (NAG), Adagrad, AdaDelta, RMSProp, Adam, and Nadam.

GD includes a method that adjusts model parameters in a direction that decreases the output of a cost function by using a current slope of the cost function.

The direction in which the model parameters are to be adjusted may be referred to as a step direction, and a size by which the model parameters are to be adjusted may be referred to as a step size.

Here, the step size may mean a learning rate.

GD obtains a slope of the cost function through use of partial differential equations, using each of model parameters, and updates the model parameters by adjusting the model parameters by a learning rate in the direction of the slope.

SGD may include a method that separates the training dataset into mini batches, and by performing gradient descent for each of these mini batches, increases the frequency of gradient descent.

Adagrad, AdaDelta, and RMSProp may methods that increase optimization accuracy in SGD by adjusting the step size. In SGD, momentum and NAG are methods that improve optimization accuracy by adjusting the step direction. Adam may include a method that combines momentum and RMSProp and increases optimization accuracy in SGD by adjusting the step size and step direction. Adam may include a method that combines momentum and RMSProp and increases optimization accuracy in SGD by adjusting the step size and step direction.

Learning rate and accuracy of the artificial neural network rely not only on the structure and learning optimization algorithms of the artificial neural network but also on the hyperparameters thereof. Therefore, in order to obtain a good learning model, it is important to choose a proper structure and learning algorithms for the artificial neural network, but also to choose proper hyperparameters.

In general, the artificial neural network is first trained by experimentally setting hyperparameters to various values, and based on the results of training, the hyperparameters may be set to optimal values that provide a stable learning rate and accuracy.

The controller 140 may be connected to the processor 170 that is configured to derive the prediction value. The processor 170 may perform learning according to the artificial intelligence model, and may derive the prediction value by receiving the performance index Lc of the compressor and performance index Lf of the cooling fan.

The processor 170 may be provided with an artificial intelligence neural network, and may derive the prediction value for the cleaning time by receiving input factors and training the artificial intelligence model based the received input factors. In this case, the input factors may include the performance indicator Lc of the compressor and the performance indicator Lf of the cooling fan.

The refrigerator may further include a transceiver configured to communicate with a server, and the controller 140 may communicate with the server through the transceiver.

The server may store the artificial intelligence model, and may also store data required for training the artificial intelligence model. Further, the server may evaluate the artificial intelligence model, and may update the artificial intelligence model for better performance even after evaluation.

The transceiver may be configured to include at least one of a mobile communication module and a wireless internet module. In addition, the transceiver may further include a short-range communication module.

The mobile communication module may transmit/receive a wireless signal to/from at least one of a base station, an external terminal, or a server on a mobile communication network established according to the technical standards or communication methods for mobile communication (for example, Global System for Mobile communication (GSM), Code Division Multi Access (CDMA), Code Division Multi Access 2000 (CDMA2000), Enhanced Voice-Data Optimized or Enhanced Voice-Data Only (EV-DO), Wideband CDMA (WCDMA), High Speed Downlink Packet Access (HSDPA), High Speed Uplink Packet Access (HSUPA), Long Term Evolution (LTE), Long Term Evolution-Advanced (LTE-A), 5G mobile communication and the like.)

The wireless internet module refers to a module for wireless internet access and may be provided in the refrigerator. The wireless internet module may be configured to transmit and receive a wireless signal through a communication network according to wireless internet technologies.

The refrigerator may transmit and receive data to and from the server and various terminals capable of performing communications, through a 5G network. In particular, the refrigerator may communicate data with the server and the terminal using at least one service of Enhanced Mobile Broadband (eMBB), Ultra-reliable and low latency communications (URLLC), and Massive Machine-type communications (MMTC), through the 5G network.

The eMBB is a mobile broadband service, and provides, for example, multimedia contents and wireless data access. In addition, improved mobile services such as hotspots and broadband coverage for accommodating the rapidly growing mobile traffic may be provided via eMBB. Through a hotspot, high-volume traffic may be accommodated in an area where user mobility is low and user density is high. Through broadband coverage, a wide-range and stable wireless environment and user mobility may be guaranteed.

The URLLC defines requirements that are far more stringent than existing LTE in terms of reliability and transmission delay of data transmission and reception, and corresponds to a 5G service for production process automation in fields such as industrial fields, telemedicine, remote surgery, transportation, safety, and the like.

The MMTC is a transmission delay-insensitive service that requires a relatively small amount of data transmission. mMTC enables a much larger number of terminals, such as sensors, than general mobile cellular phones to be simultaneously connected to a wireless access network. In this case, the communication module price of the terminal should be inexpensive, and there is a need for improved power efficiency and power saving technology capable of operating for years without battery replacement or recharging.

The processor 170 may be provided in the server. The server may receive data on the input factors from the refrigerator, and the processor 170 may derive the required prediction value for the cleaning time by training the artificial intelligence model based on the received data.

The controller 140 may receive, from the server, information on a prediction value for the cleaning time. The controller 140 may receive, from the server, information on the prediction value for the cleaning time of each condition, where the prediction value is derived by the processor 170 training the artificial intelligence model.

Here, each condition means a condition where the input factors, that is, at least one of the performance indicator Lc of the compressor or the performance indicator Lf of the cooling fan, is different from each other.

In addition, the controller 140 may specify the prediction value for each condition based on the received prediction value for the cleaning time.

Figure 11:
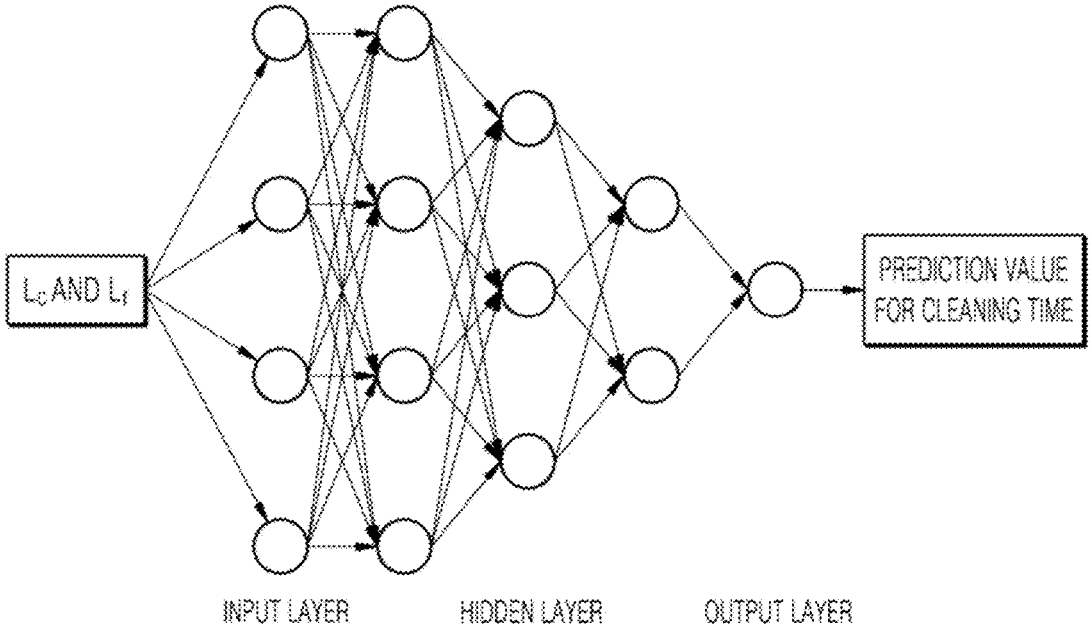
FIG. 11 is a diagram illustrating an artificial intelligence neural network, according to one embodiment.

FIG. 11 is a diagram illustrating an artificial intelligence neural network, according to one embodiment. The artificial intelligence neural network may be provided in the processor 170, and the processor 170 may train the artificial intelligence model through the artificial intelligence neural network.

In this case, the learning of the artificial intelligence model according to one embodiment may be, for example, non-supervised learning, but is not limited thereto.

The prediction value for the cleaning time may be a value in conditions where at least one of the performance indicator Lc of the compressor or the performance indicator Lf of the cooling fan is different, in a learning mode according to the artificial intelligence model.

When each condition is different, the prediction value for the cleaning time to be derived may also be different. By training of the artificial intelligence model, different prediction values for the cleaning time may be derived for each condition.

Such learning of the artificial intelligence model may be performed in the artificial intelligence neural network composed of an input layer to which input factors are inputted, an output layer that derives the prediction value for the cleaning time, and a plurality of hidden layers between the input layer and the output layer.

The processor 170 may derive the prediction value for the cleaning time by receiving the input factors and training the artificial intelligence model based the received input factors.

As described above, the input factors may include the performance indicator Lc of the compressor and the performance indicator Lf of the cooling fan. In addition to these, other factors influencing the prediction value for the cleaning time may be additional input factors.

When the input factors having different conditions are inputted to the artificial neural network, the processor 170 may derive the prediction value for the cleaning time corresponding to that condition by training the artificial intelligence model.

For example, when an RNN is used as the artificial intelligence learning model, the input factors of different conditions are sequentially inputted to the artificial neural network at different times, and the input factors are combined and calculated in the hidden layers, whereby the required prediction value for the cleaning time under each condition where the input factors are different from each other may be derived.

Referring back to FIG. 1, the refrigerator may further include a memory 180 that is configured to store information on the prediction value for the cleaning time. The prediction value for the cleaning time is a value that is learned by the processor 170 under conditions with different input factors. That is, the derived prediction value for the cleaning time that is derived in the processor 170 may be stored in the memory 180.

The controller 140 may select the prediction value for the cleaning time based on information on the prediction value for the cleaning time stored in the memory 180. The prediction value for the cleaning time under conditions where the input factors are different may be stored in the memory 180.

Accordingly, the controller 140 may use the information stored in the memory 180 to select the prediction value for the cleaning time corresponding to the performance indicator Lc of the compressor and the performance indicator Lf of the cooling fan at the present time, and inform the user of the selected prediction value.

According to embodiments of the present disclosure, the processor 170 may train the artificial intelligence model frequently while the refrigerator is operating. Also, information on the input factors and the prediction value for the cleaning time changed according to the learning result may be updated in the memory 180.

Meanwhile, the above-described particular value and the first reference value to the fifth reference value may also be derived by learning according to the artificial intelligence model, in a manner similar to deriving the prediction value for the cleaning time of the machine room 10.

According to the embodiments of the present disclosure, it is possible to increase the convenience of the user by identifying the installation state of the refrigerator and informing the user when the installation state is poor, by the refrigerator itself.

According to the embodiments of the present disclosure, it is possible to increase the convenience of the user by informing the user of the malfunction of the refrigerator, by the refrigerator itself.

According to the embodiments of the present disclosure, it is possible to increase the convenience of the user by determining the cleaning time of the machine room 10 or by predicting the cleaning time and informing the user thereof, by the refrigerator itself.

While the invention has been explained in relation to its embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A refrigerator diagnostic method, the method comprising:

determining an installation state of a refrigerator based on a power value of a compressor provided in the refrigerator and a number of revolutions of a cooling fan provided in the refrigerator, and further based on an operating time after an initial installation of the refrigerator being less than or equal to a particular value, wherein the refrigerator further comprises:

a condenser connected to the compressor and configured to be cooled by the cooling fan; and at least one controller configured to control operations of the compressor, the cooling fan, and the condenser; and determining at least one of a malfunction or a cleaning state of the refrigerator in which cleaning is required based on the power value of the compressor and the number of revolutions of the cooling fan, and further based on the operating time after the initial installation of the refrigerator being greater than the particular value, wherein determining at least one of the malfunction or the cleaning state of the refrigerator comprises:

calculating a performance indicator of the compressor;

checking whether the performance indicator of the compressor is greater than a first reference value;

measuring the number of revolutions of the cooling fan based on the performance indicator of the compressor being greater than the first reference value;

checking whether the measured number of revolutions of the cooling fan is greater than a second reference value;

informing a user of the malfunction of the refrigerator based on the measured number of revolutions of the cooling fan being less than or equal to the second reference value; and determining a performance indicator of the cooling fan based on the measured number of revolutions of the cooling fan being greater than the second reference value, wherein the performance indicator of the cooling fan is determined as follows:

(number of revolutions of cooling fan at present time)/(number of revolutions of cooling fan at initial installation of refrigerator).

2. The method of claim 1, wherein the at least one controller is further configured to determine the installation state, the malfunction, and the cleaning state of the refrigerator.

3. The method of claim 2, wherein determining the installation state of the refrigerator comprises:

measuring the power value of the compressor;

checking whether the measured power value of the compressor is greater than a third reference value;

measuring the number of revolutions of the cooling fan based on the measured power value of the compressor being greater than the third reference value; and checking whether the measured number of revolutions of the cooling fan is less than a fourth reference value.

4. The method of claim 3, wherein determining the installation state of the refrigerator further comprises informing a user of a poor installation state of the refrigerator based on the measured number of revolutions of the cooling fan being less than the fourth reference value.

5. The method of claim 2, wherein the refrigerator has a machine room in which the compressor, the cooling fan, and the condenser are installed.

6. The method of claim 5, wherein the at least one controller is further configured to determine at least one of a malfunction of the cooling fan or a cleaning state of the machine room.

7. The method of claim 5, wherein determining at least one of the malfunction or the cleaning state of the refrigerator further comprises:

checking whether the performance indicator of the cooling fan is less than a fifth reference value.

8. The method of claim 7, wherein the performance indicator of the compressor is calculated as follows:

(compressor power at present time)/(compressor power at initial installation of refrigerator).

9. The method of claim 7, wherein determining at least one of the malfunction or the cleaning state of the refrigerator further comprises informing a user that a cleaning time of the machine room has been reached based on the performance indicator of the cooling fan being less than the fifth reference value.

10. The method of claim 7, wherein determining at least one of the malfunction or the cleaning state of the refrigerator further comprises predicting a cleaning time of the machine room based on the performance indicator of the cooling fan being greater than or equal to the fifth reference value.

11. The method of claim 10, wherein a prediction value for the cleaning time of the machine room is derived by learning according to an artificial intelligence model based on the performance indicator of the compressor and the performance indicator of the cooling fan.

12. The method of claim 11, wherein the at least one controller is connected to at least one processor configured to derive the prediction value, and the at least one processor is further configured to perform learning according to the artificial intelligence model and derive the prediction value by receiving the performance indicator of the compressor and the performance indicator of the cooling fan.

13. The method of claim 12, wherein the prediction value is a value in conditions where one of the performance indicator of the compressor or the performance indicator of the cooling fan is different from the other in a learning mode according to the artificial intelligence model.

14. A refrigerator comprising:

a compressor;

a condenser connected with the compressor;

a cooling fan configured to cool the condenser; and at least one controller configured to control operations of the compressor, the cooling fan, and the condenser, wherein the at least one controller is further configured to:

determine an installation state of the refrigerator based on a power value of the compressor and a number of revolutions of the cooling fan, and further based on an operating time after an initial installation of the refrigerator being less than or equal to a particular value; and determine at least one of a malfunction or a cleaning state of the refrigerator in which cleaning is required based on the power value of the compressor and the number of revolutions of the cooling fan, and further based on the operating time after the initial installation of the refrigerator being greater than the particular value, by:

calculating a performance indicator of the compressor;

checking whether the performance indicator of the compressor is greater than a first reference value;

measuring the number of revolutions of the cooling fan based on the performance indicator of the compressor being greater than the first reference value;

checking whether the measured number of revolutions of the cooling fan is greater than a second reference value; and determining a performance indicator of the cooling fan based on the measured number of revolutions of the cooling fan being greater than the second reference value, wherein the performance indicator of the cooling fan is determined as follows:

(number of revolutions of cooling fan at present time)/(number of revolutions of cooling fan at initial installation of refrigerator).

15. The refrigerator of claim 14, wherein the refrigerator has a machine room in which the compressor, the cooling fan, and the condenser are installed, and the at least one controller is further configured to determine at least one of a malfunction of the cooling fan or a cleaning state of the machine room.

16. The refrigerator of claim 15, wherein the at least one controller is further configured to predict a cleaning time of the machine room, and a prediction value for the cleaning time of the machine room is derived by learning according to an artificial intelligence model based on the performance indicator of the compressor and a performance indicator of the cooling fan.

* * * * *